US007846259B2

(12) United States Patent
Magliocca

(10) Patent No.: US 7,846,259 B2
(45) Date of Patent: Dec. 7, 2010

(54) PARTS WASHING APPARATUS WITH CENTRIFUGAL FILTER

(76) Inventor: Charles T. Magliocca, 12742 E. 36th St., Yuma, AZ (US) 85367

( * ) Notice: Subject to any disclaimer, the term of this patent is extended or adjusted under 35 U.S.C. 154(b) by 0 days.

(21) Appl. No.: 11/837,436

(22) Filed: Aug. 10, 2007

(65) Prior Publication Data

US 2009/0038643 A1 Feb. 12, 2009

(51) Int. Cl.
*B08B 7/00* (2006.01)
*B08B 9/20* (2006.01)

(52) U.S. Cl. ..... 134/10; 134/25.1; 134/25.4; 134/42

(58) Field of Classification Search ..... None
See application file for complete search history.

(56) References Cited

U.S. PATENT DOCUMENTS 5,954,071 A 9/1999 Magliocca
6,068,707 A * 5/2000 Magliocca ..... 134/10
6,306,221 B1 10/2001 Magliocca
6,398,877 B1 6/2002 Magliocca
2006/0289348 A1 * 12/2006 Steinbeck ..... 210/224

* cited by examiner

*Primary Examiner*—Michael Cleveland
*Assistant Examiner*—Nicole Blan
(74) *Attorney, Agent, or Firm*—Dwayne E. Rogge; Hughes Law Firm, PLLC

(57) ABSTRACT

A parts washing apparatus comprising a basin having a drain, a reservoir located below the drain, and a solvent filtering and recirculating system. This system comprises a centrifuge filter assembly and a solvent recirculating system. The centrifuge filter assembly in turn comprises a centrifugal filter comprising a receptacle and a replaceable filter element, and also a turbine to drive the centrifugal filter. The centrifuge filter and the turbine are positioned in an enclosing structure to enclose the turbulent flow of the solvent from the centrifuge filter and also enclose the fumes associated with the turbulent flow. Thus, there is a discharge of solvent as less turbulent flow while substantially enclosing the associated fumes.

3 Claims, 8 Drawing Sheets

PARTS WASHING APPARATUS WITH CENTRIFUGAL FILTER

CROSS REFERENCE TO RELATED APPLICATIONS

The present patent application incorporates subject matter from four earlier patents of the undersigned, namely, U.S. Pat. No. 5,954,071, issued Sep. 21, 1999, U.S. Pat. No. 6,068,707, issued May 30, 2000, U.S. Pat. No. 6,306,221 B1, issued Oct. 23, 2001, and U.S. Pat. No. 6,398,877 B1, issued Jun. 4, 2002. The present application incorporates by reference the subject matter contained in these four earlier issued patents, and copies of these are enclosed.

BACKGROUND OF THE INVENTION

1. Field of the Invention

The present invention relates generally to the field of parts washing apparatus and methods, and particularly to a parts washing apparatus having a centrifugal filter to separate foreign waste elements from a cleaning solvent or other cleaning liquid.

2. Background Art

Parts washers are widely used in industrial applications, and in particular, automotive service shops. The more familiar part washer can be found in almost any service station in the United States. It is comprised of a sink (a wash basin) with a spigot and a drain that sits upon a standard 45 gallon drum. The drum functions as a reservoir and is partially filled with a parts washing solvent. The solvent is pumped from the drum and through the spigot, where it flows over the dirty part or parts and into the sink's drain, from which it flows through the drain into the drum. In this manner, the solvent continuously flows over the dirty parts while the operator washes the parts in the sink.

A problem with these conventional parts washers is that the foreign material washed from the dirty parts flows into the drum along with the solvent. In many applications, the foreign material will be comprised of contaminants, metal shavings, dirt, sand, grit, and oil particulates, and these will be referred to generally as "foreign matter". Since much of this debris will remain suspended in the solvent while the pump is running, the pump is continuously subjected to substances that will damage its internal seals. Another problem is that after the solvent becomes sufficiently contaminated, it must be disposed of as contaminated waste and be given special treatment. This can be very expensive.

Much of the background art in this area has addressed this particular problem by placing a filter upstream of the pump to strain foreign debris from the solvent before it reaches the pump. For instance, in U.S. Pat. No. 4,056,114 (Boutillete), the pump is surrounded by a filter element. U.S. Pat. No. 3,890,988 (Lee) teaches a pump mounted at the top of a truncated cone that rests at the bottom of a solvent tank. The cone is made from a screen that is intended to filter the solvent before it reaches the inlet of the pump.

Additionally, the four patents cross-referenced above, namely U.S. Pat. No. 5,594,071, U.S. Pat. No. 6,068,707, U.S. Pat. No. 6,306,221 B1, and U.S. Pat. No. 6,398,877 B1, all show a wash basin to contain the solvent, and this solvent flows through a drain toward the reservoir which contains the solvent. However, instead of directing the solvent directly into the reservoir, it flows into a centrifugal filter which separates the undesirable foreign matter, such as fragments, crud, etc. from the solvent. The solvent which passes through the filter is moved by gravity into the underlying reservoir. Periodically after a quantity of the waste material collects within the filter element, the filter element with the contained foreign matter is periodically removed and sent to a disposal location. There is at the bottom part of the reservoir a pump which recirculates solvent in the reservoir upwardly into the basin. The subject matter of these two prior art patents are discussed further in the text of the patent application.

The method disclosed in these four patents noted above substantially reduces the problems of having to dispose of the contaminated waste, since it is much easier to do so with only the replaceable filter element, instead of more frequently disposing of the entire batch of solvent. However, there is another matter which deserves attention and this is that the fumes resulting from the solvent can be considered as environmentally objectionable. Thus, there exists a need to consider the precautions or measures that could be taken to limit the fumes that are emanated from the solvent.

It is toward these problems that the embodiments of the present invention are directed.

SUMMARY OF THE INVENTION

The present invention comprises a parts washing apparatus comprising a basin having a drain, a reservoir located below the drain, and a solvent filtering and recirculating system. This comprises a centrifugal filter assembly and a solvent recirculating system. The centrifugal filter assembly in turn comprises a centrifugal filter comprising a receptacle and a replaceable filter element, and also a turbine to drive the centrifugal filter.

The centrifugal filter and the turbine are positioned in an enclosing structure to enclose turbulent flow of the solvent from the centrifugal filter and also enclose the fumes associated with the turbulent flow. Thus, there is a discharge of solvent as less turbulent flow while substantially enclosing the associated fumes.

DESCRIPTION OF THE EMBODIMENTS OF THE INVENTION

Preliminary Description of Prior Art a) Introduction

Figure 1:
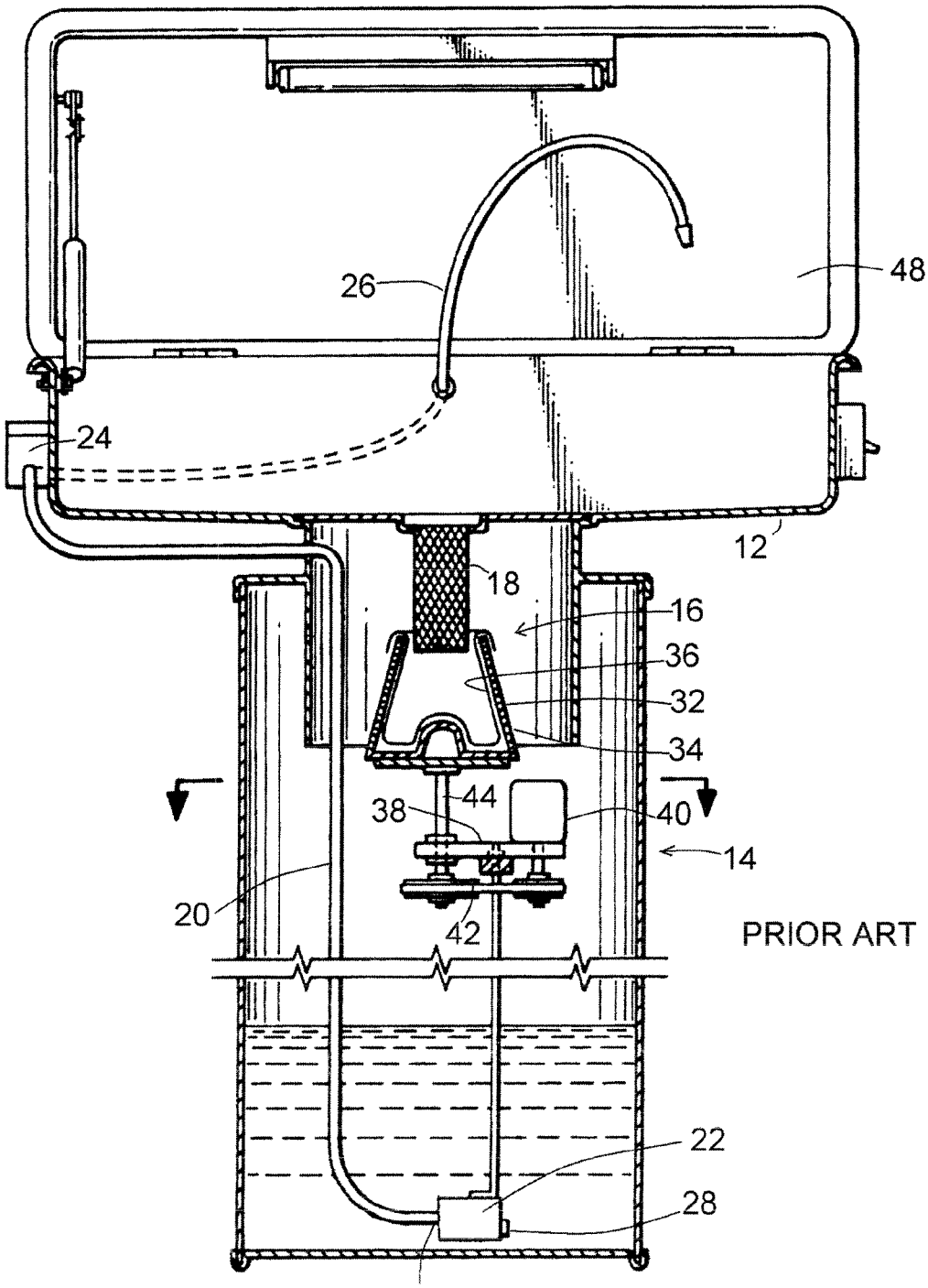
FIG. 1 PRIOR ART
FIG. 1 is a view of the prior art system shown in U.S. Pat. No. 5,954,071, with this being a sectional view taken along a vertical plane.

It is believed that a clearer understanding of the present invention will be obtained by first reviewing, with reference to FIG. 1, the prior art system that is described and claimed in my earlier patent U.S. Pat. No. 5,954,071, followed by a brief review of a prior art embodiment shown in U.S. Pat. No. 6,068,707. The descriptions in these patents are incorporated in the present application by reference, so these will be described only briefly in these remarks being presently provided. For ease of explanation, numerical designation other than those used in the prior art patents are used in the brief descriptions that follow.

b) Brief Description of Two Referenced Prior Art Patents i) Description of U.S. Pat. No. 5,954,071

With reference to FIG. 1, there is a wash basin 12 containing a solvent that is used to wash parts. Below this wash basin 12, there is a solvent reservoir 14. Located above, or in the upper portion of the reservoir 14, is a centrifugal filter assembly 16 which receives the solvent from the drain 18 of the wash basin.

To return solvent from the reservoir 14 to the wash basin 12, there is provided a solvent return pipe 20 which delivers solvent from a submersible pump 22 to the wash basin 12. More specifically, the transfer pipe 20 carries the solvent to a filter 24 that in turn delivers the solvent to a discharge hose 26 leading into the basin 12. The pump 22 has an inlet 28 and an outlet 30 leading to the solvent transfer pipe 20.

The centrifugal filter assembly 16 comprises a rotatably mounted receptacle 32 that comprises a perforated sidewall 34. A replaceable filter element 36 is positioned in the receptacle 32, and as this filter element collects a quantity of the foreign particles, such as crud and other contaminants in the solvent, the filter element can be removed and then delivered to a disposal site, with a second filter element being placed in the operating position in the receptacle 32.

There is provided a support member 38 on which is mounted a motor 40 which connects to a pulley and belt drive 42 that in turn drives a driveshaft 44 that causes the centrifugal filter assembly 16 to rotate.

Also, there is shown a hood 48 which can be hinge mounted and positioned above the basin 12. Even though the solvent generally has a high flashpoint so that it rarely is set on fire, there are fusible links which would give way when heated to cause the hood to drop down to smother the flame.

ii) Description of U.S. Pat. No. 6,068,707

There will now be a brief description of a portion of U.S. Pat. No. 6,068,707, and this will be done to reference to FIG. 1A which is a view similar to FIG. 1, but showing a second embodiment in FIG. 9 of U.S. Pat. No. 6,068,707. There will be given some numerical designations similar to those given in FIG. 1, but with an "a" suffix distinguishing those of the embodiment shown in FIG. 1A of U.S. Pat. No. 6,068,707.

There is a basin 12*a*, a reservoir 14*a* and a centrifugal filter assembly 16*a* which are quite similar (or substantially the same as) those components of FIG. 1. Also, there is a tube 20*a* that carries solvent from the reservoir 14*a* up to two discharge hoses 26*a*.

Figure 1A:
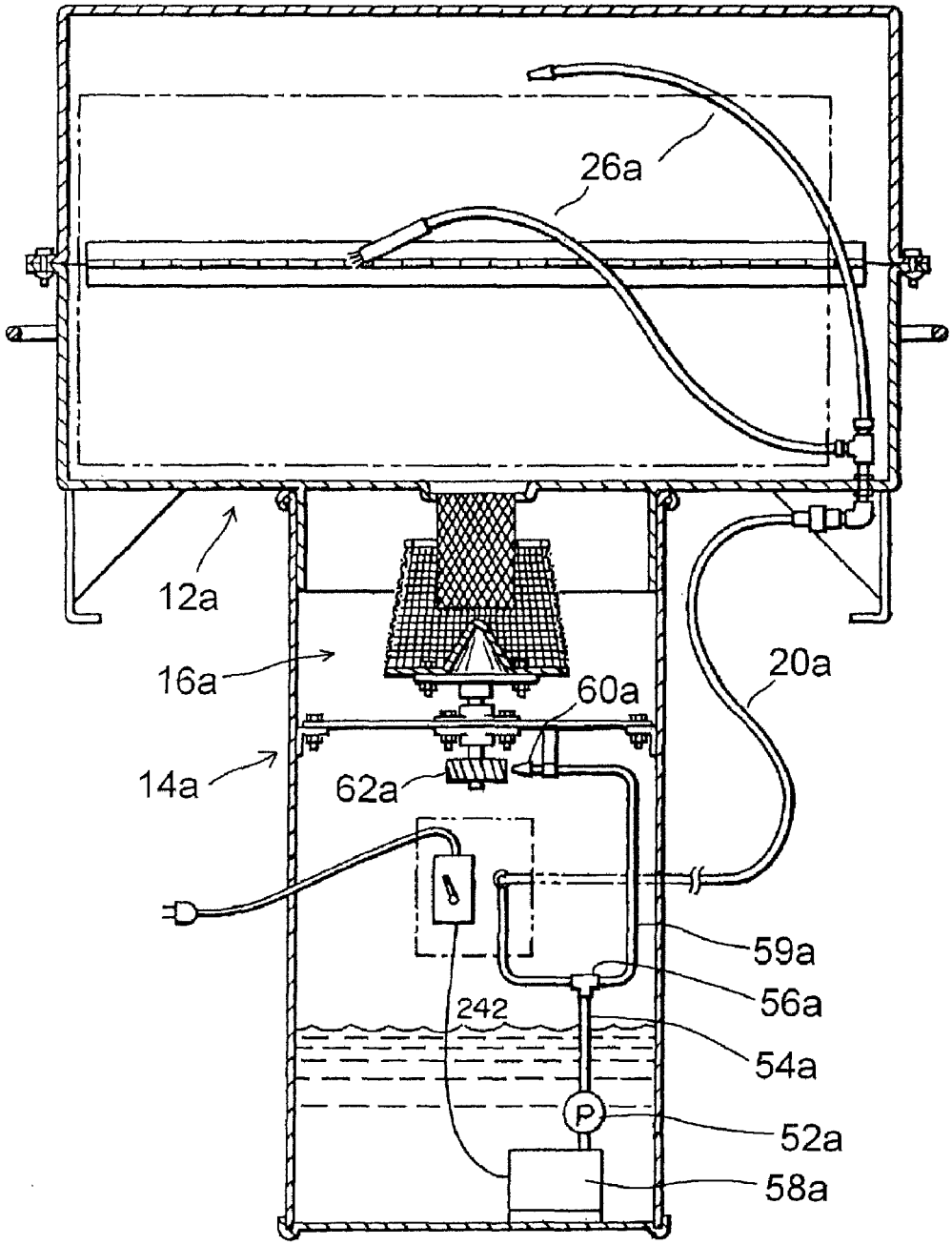
FIG. 1A PRIOR ART
FIG. 1A is a view similar to FIG. 1 showing the prior system shown as a second embodiment in U.S. Pat. No. 6,068,707.

The main differences in this prior art parts washing apparatus of FIG. 1A are the mechanisms by which the centrifugal filter assembly 16*a* is rotated.

In FIG. 1A there is shown a motor 58*a* which drives a pump 52*a* that in turn pumps the solvent in the reservoir 14*a* through a line 54*a* to a T-connector 56*a*. One branch of the T-connector delivers solvent through the line 20*a* to return to the basin 12*a*. However, the second branch from the T-connector 56*a* delivers the solvent through a line 59*a* to a nozzle 60*a* to drive a turbine 62*a*. The turbine 62*a* in turn connects to a drive shaft to rotate the centrifugal filter assembly 16*a*.

c) Description of the Embodiment of the Present Invention

With the introduction of the two prior art patents being given, there will now be a description of the embodiment of present invention.

Figure 2:
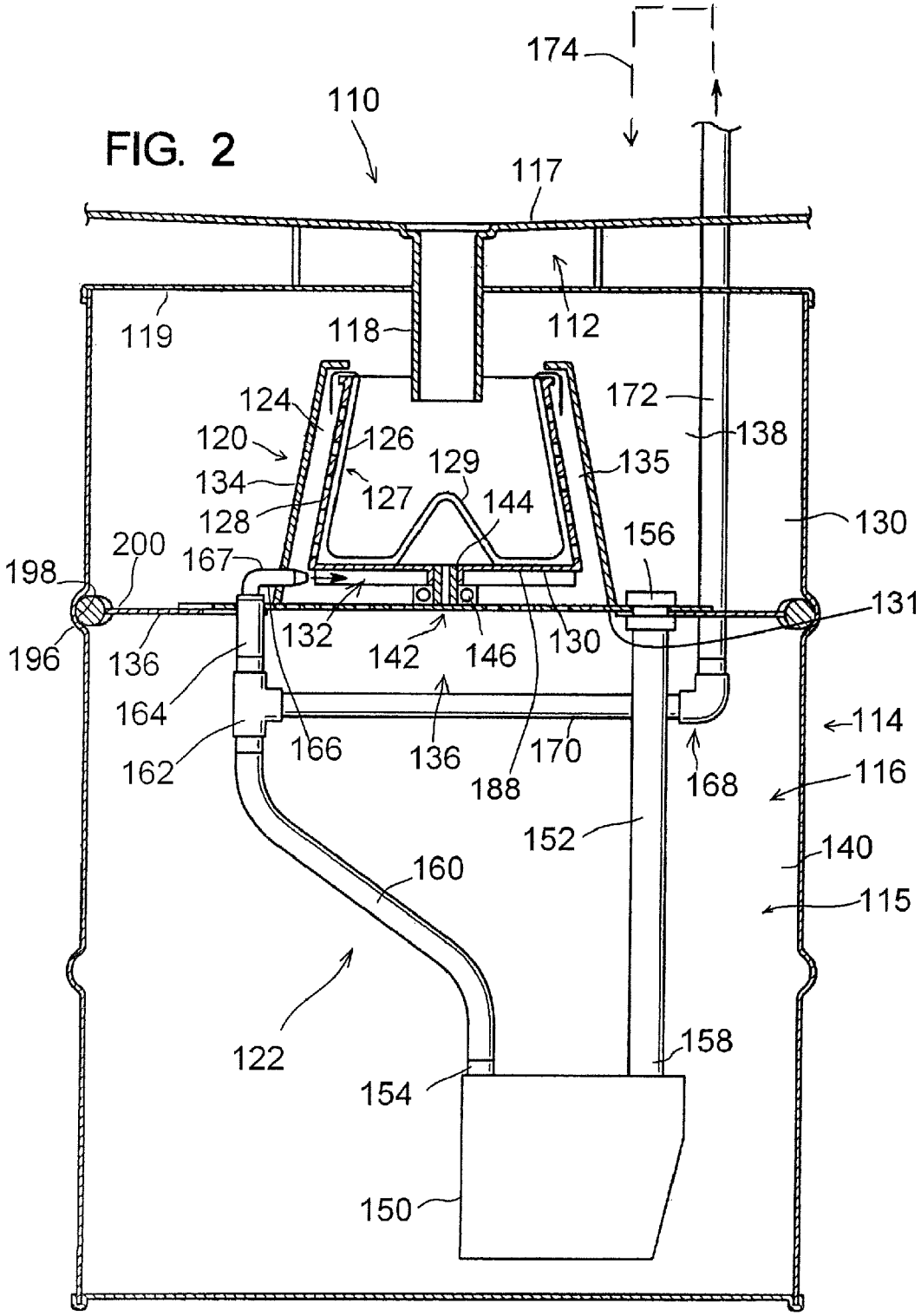
FIG. 2 is a sectional view similar to FIG. 1 showing components of an embodiment of the present invention, taken along line 2-2 of FIG. 3.

With reference first to FIG. 2, the apparatus 110 comprises a wash basin 112, a solvent reservoir 114 having containing chamber 115, and a solvent filtering and recirculating system 116. The wash basin 112 of this embodiment is or may be similar to, or the same as, the wash basin shown in U.S. Pat. No. 5,954,071 and U.S. Pat. No. 6,068,707. Accordingly, for ease of illustration, only part of the bottom wall 117 and the drain 118 of the basin 112 are shown in FIG. 2. There is a removable lid 119 covering the reservoir 114.

The drain 118 is positioned in the basin floor 117, and the wash basin 112 is positioned above a reservoir 114. The cleaning solvent is contained in both the wash basin 112 and the reservoir 114.

This aforementioned solvent filtering and recirculating system 116 comprises;

i) a centrifuge filter assembly 120; and ii) a solvent recirculating system 122.

To describe first the centrifuge filter assembly 120, this comprises a centrifugal filter which in turn comprises a rotatably mounted receptacle 124 and a replaceable filter element 126 that is placed in the receptacle 124. The combination of the receptacle 124 and the filter element 126 shall be referred to as the centrifugal filter 127. This filter element 126 could be made of a flexible material and may be inserted so that its edges would overhang the upper edge of the receptacle 124 to maintain the filter element 126 in place.

The receptacle 124 comprises a surrounding sidewall 128 which has the overall configuration of a downwardly expanding truncated cone and which is perforated to permit the flow of solvent therethrough. Also, the receptacle 124 comprises a bottom plate 130. There is a central cone shaped member 129 which protrudes upwardly from the bottom plate 130 in the middle of the centrifuge receptacle 124. This causes the solvent being directed into the receptacle 124 to spread outwardly toward the outer part of the centrifuge so as to improve its performance.

The centrifuge filter assembly 120 further comprises a turbine 132 which is positioned adjacent to and below the bottom wall 130 and has a drive connection to the receptacle 124. As will be described hereinafter, the turbine 132 serves the function of rotating the receptacle 124 with its filter element 126.

The centrifugal filter assembly 120 also comprises an enclosing structure in the form of an outer circumferential stationary housing 134 which has a downwardly expanding truncated cone configuration, and extending around the circumferential sidewall 128 of the receptacle 124. This circumferential housing 134 is spaced radially outwardly from the surrounding sidewall 128 of the receptacle 124 and has at its upper edge a radially inwardly extending circumferential lip 137 to define with the sidewall 128 a substantially closed downwardly expanding circumferential space 135. The lower edge 131 of the housing 134 is located so as to leave a small gap 133 of possibly 0.05 inch to 0.1 inch over the adjacent upper surface of the partitioning and support section 136 to enable solvent from the centrifugal filter operation and the turbine 132 to flow out in a controlled manner.

There is a partitioning and support section 136 which is mounted in the reservoir chamber 115 about two-thirds of the way up from the bottom of the reservoir 114. As will be described later herein, in addition to serving a support function this partitioning and support section 136 serves a partitioning function in a manner that there is:

i) an upper operating zone 138 in which the centrifugal filter assembly 12 is located; and ii) a lower solvent retaining zone 140 in which reservoir retains the solvent and in which a major portion of the solvent recirculation system 122 is located.

This partitioning and support section 136 has at its center, a rotary mounting support 142 comprising a rotating center mounting member 144 connecting to the bottom wall 130 of the receptacle 124 and supported by bearings 146. In addition, this support section 136 provides support for other components of the filtering and recirculating system 116.

To discuss further now the solvent recirculating system 122, a submersible pump 150 is supported by a positioning rod 152 and is positioned in the lower part of the reservoir 114, and this pump 150 has a solvent inlet (not shown) and an outlet 154. The pump 150 is positioned a short distance above a bottom wall of the reservoir by means of the mounting rod 152 having an upper connection 156 to the support section 136 and a lower connection 158 to the pump 150.

A main outlet line 160 carries the solvent delivered from the pump 150 up to a T-connection 162. A power providing line 164 extends from the T-connection 162 and extends to an elbow 166 that in turn discharges the solvent under pressure to a jet discharge member 167 to drive the turbine 132.

There is a second line which is a recirculating line 168 which has a horizontal section 170 leading from the T-connection 162 and extending upwardly as a line section 172 and thence through a discharge section shown schematically as the downwardly directed broken line 174 directing the solvent to the solvent basin 122. This discharge section 174 could be a hose as shown at 26 in FIG. 1.

Figure 3:
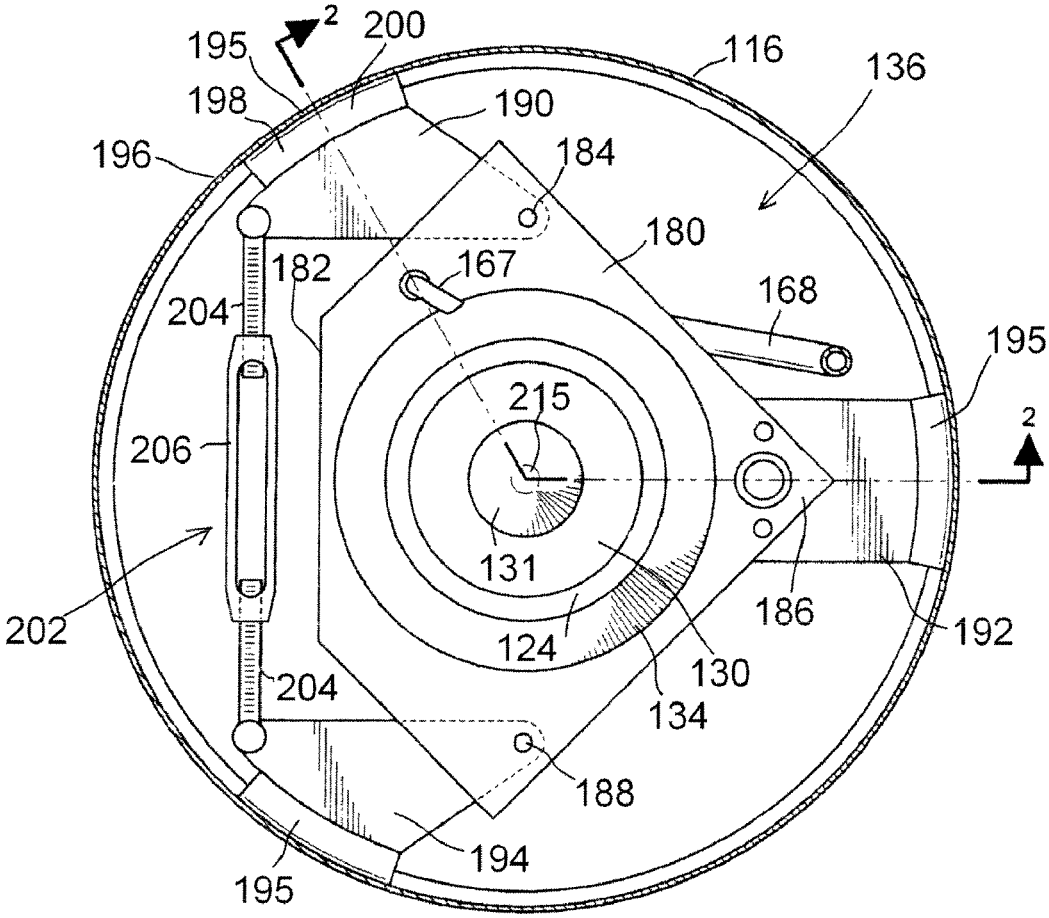
FIG. 3 is a view looking downwardly on the components shown in FIG. 2, but with the bottom wall of the basin and also the top cover of the reservoir being removed showing mounting components in the release position.

To describe the partitioning and support section 136, reference is now made to the top view of FIG. 3. The partitioning and support section 136 extends across the diameter of the reservoir 114. It comprises a somewhat square-like, centrally positioned partitioning and support plate 180 which has four functional locations at corners around its perimeter, with one corner cut off at 182 to provide space for an adjustment tool (i.e., a turn buckle shown at 202 in FIGS. 3 and 5). Thus, there are remaining three corner located locations 184, 186, and 188 which function as connecting locations for three support arms 190, 192, and 194 to the support plate 180. Two of these positioning locations 184 and 188 are pivot connections 184 and 188 for the arms 190 and 192, respectively. The connection at 186 is a fixed connection for the arm 192. Each of the three arms 190, 192, and 194 has outer connecting locations at 195 to the interior surface of the reservoir 114 and are spaced approximately 120° from one another.

As indicated previously in this text, in general the reservoir 116 is commonly in the form of a metal drum, and it has two or more outwardly protruding circumferential ridges 196 that form internal circumferential grooves 198 at the inside surface of the drum (i.e., reservoir 114). The outer ends of each of the three support arms 190, 192, and 194 have an outer moderately curved cylindrically shaped connecting portion 200 that fits in the groove 198. The middle arm 192 has a fixed connection to its adjacent corner location 186, while the other two arms 190 and 194 have pivot connections at 184 and 188 that restrict the arms 190 and 194 to rotate along a vertical axis. These two arms 190 and 194 can be rotated further outwardly from one another to the connect position of FIG. 3 or be drawn inwardly to the disconnect position of FIG. 5.

Figure 5:
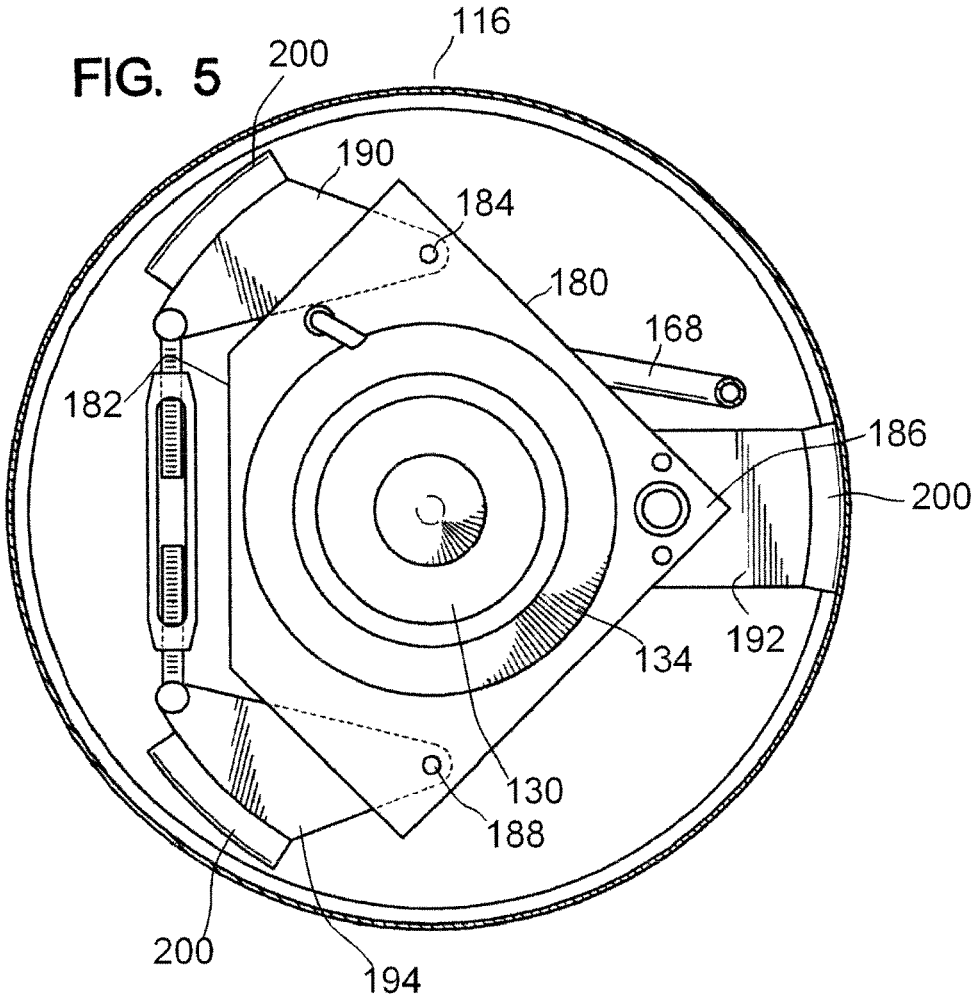
FIG. 5 is a view similar to FIG. 3, but showing the mounting components of a support section of the present invention in its release position where it can be removed out of the reservoir.

The movement of the arms 190 and 194 is accomplished by the aforementioned turn buckle 202 comprising two screws 204 and a middle member 206. The outside ends of the screws 204 are connected to outer end portions of their related arms 190 and 194. In FIG. 3 the three arms 190 to 194 shown are spaced from one another by a distance so that the three connecting portions 200 of all three arms 190, 192, and 194 are positioned in the groove 198. In FIG. 5, the middle member 206 of the turn buckle 202 has been rotated to retract the two screws 204 and thus move their related connecting portions 200 out of the groove 198 so that all three connecting portions 200 are disconnected and the components of the system lifted out of the reservoir (drum) 114 as a unit.

With further reference to FIG. 3, the jet outlet 167 that drives the turbine 132 is shown. Also, there can be seen a portion of the solvent return line 168. In FIG. 3 a portion of the bottom plate 130 of the receptacle 124 can be seen, and outside of that in FIG. 3 there is the frusto-conical surface of the outer housing 134 of the centrifuge assembly.

Figure 4:
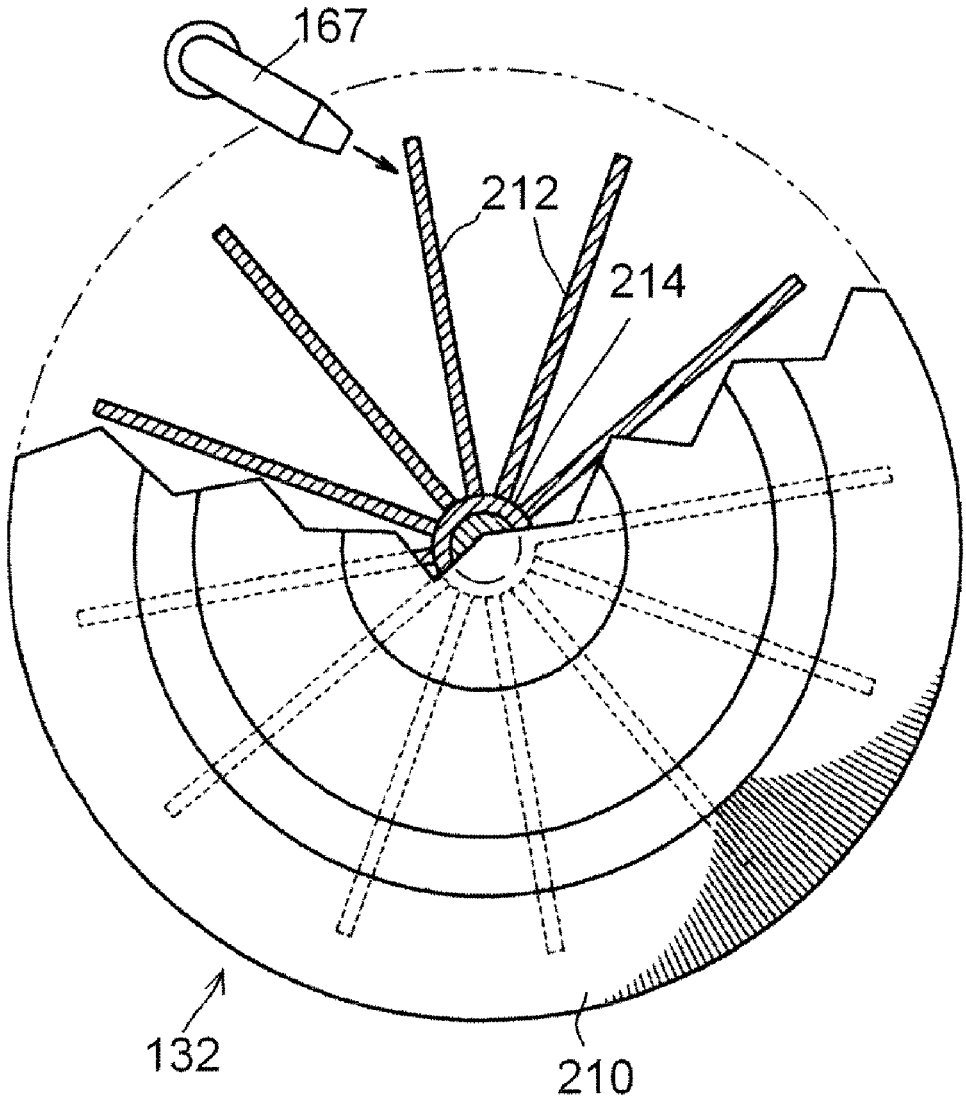
FIG. 4 is a somewhat schematic view showing the turbine drive incorporated in this embodiment of the present invention.

Reference is now made to FIG. 4 which shows somewhat schematically the turbine 132. This comprises a circular top plate 210 and turbine blades 212 that are attached by their upper edges to (or made integrally with) the top plate 210. The lower edges of the blades 212 are positioned about one quarter of an inch above the partitioning and support plate 180 and the spaces between the blades 212 are downwardly open. The region 216 below the blades 212 and above the plate 18 receives the flow of solvent from the turbine 132. For convenience, these blades 212 are shown only schematically as having a planar configuration. However, in the actual construction of the turbine 132, these blades 212 would be made in a hydro-dynamically optimized curve. The jet nozzle 167 is shown as directing its solvent stream against the turbine blades. The blades rotate about the center axis at 214.

To proceed now to the method of the present invention, as a first step the components of the centrifuge filter assembly 120 and the solvent recirculating system 122 (including the pump 150) are previously assembled with the filter element 126 in place. Then this entire assembly is positioned in the reservoir 114 as shown in FIG. 2 with the connecting portions 200 being aligned with the circumferential groove. The turn buckle 202 is operated to move the connecting portions into their mounting position. After this, the basin 112 is positioned above the upper end of the reservoir 116.

The pump 150 is, as indicated earlier, a submersible pump, and it would have an electric motor which would be connected to wires that extend to a power source outside of the reservoir 114. As soon as the pump 150 is put into operation, two things happen.

The solvent in the reservoir 116 is pumped through the main line 160 to the T-connection 162. As the fluid reaches the T-connection, a portion of the flow goes through power line 164 to exit from the jet outlet 167 to drive the turbine 132 to cause the rotation of the centrifuge filter assembly 120.

At the same time, the second portion of the flow travels through the recirculating line 168, and moves upwardly to be deposited in the wash basin 112 as indicated by the broken line at 174 of FIG. 2. The solvent in the basin 112 will be used to wash parts. In one mode of operation the solvent would continuously flow through the drain 118 and into the upper opening in the centrifugal filter assembly 120 as the solvent is continuously being directed into the reservoir 14.

As the assembly 120 rotates, the solvent will pass through the filter element 126 and through the perforations in the circumferential sidewall 128 of the receptacle 124 into the region 135 between the receptacle circumferential wall 126 in the outer housing wall 134 to drop down onto the partitioning and support plate 180. Also, the solvent that is driving the turbine 32 drops into the region 216 and onto the partitioning and support plate 180 in substantially the entire surface area within the lower edge of the housing 134.

The lower edge of the housing is about 0.05 to 0.1 inch above the upwardly facing surface of the partitioning and support plate. The solvent that collects on the partitioning and support pate 180 flows through the gap 220 under the lower edge 133 of the housing 134 and laterally over the adjacent portion of the plate 180 and over the edge of the plate 180 and into the reservoir 114. This rather narrow circumferential gap 133 impedes flow of the fumes, and with the flow of the solvent through the gap, the flow of the fumes is further impeded or blocked. This cycle continues until the pump 150 is shut down and the solvent flows through the drain 118 to empty the solvent in basin 112. Alternatively, the flow could be blocked to leave some of the solvent in the basin 112.

After a period of time when there is an accumulation of foreign matter (e.g., metal savings, contaminants, gunk, etc.) in the filter element 126, the filter element 126 is removed and replaced by another one. Then the filter element 126 that has been removed is handled as contaminated waste and delivered to the appropriate contaminated waste location for treatment.

Figure 6:
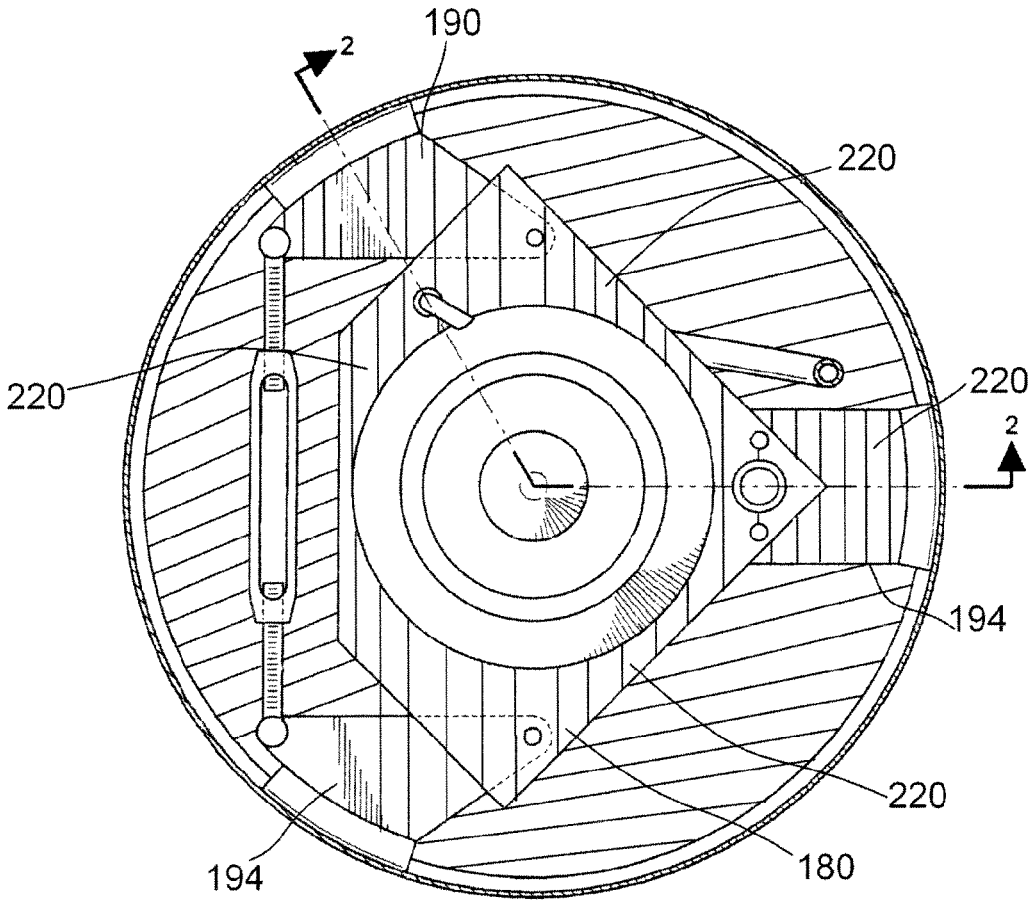
FIG. 6 is a view similar to FIG. 3 indicating the regions of the support and partitioning surfaces and the open space areas.
Figure 7:
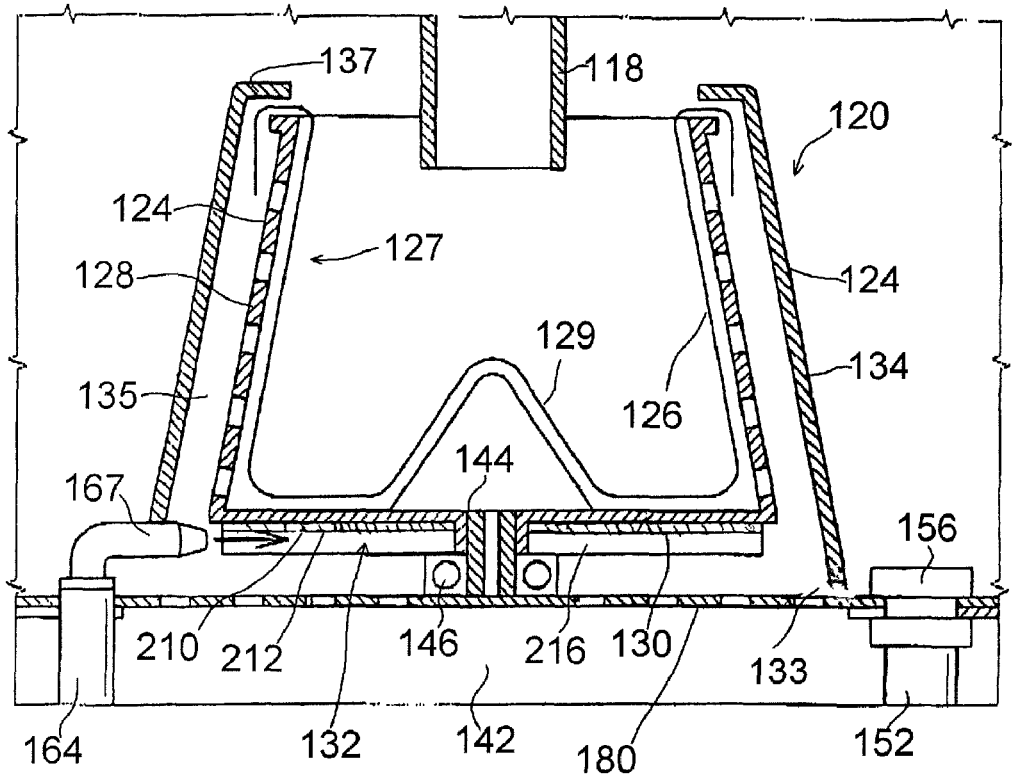
FIG. 7 is a view similar to FIG. 2 but it is drawn to an enlarged scale and only shows the centrifuge filter assembly.

To explore further some facets of the present invention, further reference is made to FIG. 3 and also to FIG. 6. It will be noted that the entire centrifugal filter assembly 120 (including the outer housing 134) is positioned within the area of the partitioning and support plate 180. Also, as can be seen from viewing FIG. 2, as well as FIG. 3, the perimeter of the turbine 132 is also within the upper surface area of the partitioning and support plate 180. Thus, the solvent that is discharged from the centrifugal filter assembly 120 and from the turbine 132 drops into the collecting region 216 at the upper surface of the partitioning and support plate 180 to flow laterally under the circumferential gap 133 formed at the lower edge of the housing 135.

This can be seen more easily by viewing to FIG. 6, which is the same as FIG. 3, except much of the numbering presented earlier in this text has for clarity been deleted. Further, the portions of the horizontal surface of the partitioning and support plate 180 and the horizontal upper surface of each of the arms 190, 192, and 194 that are exposed are indicated by the spaced vertical lines and are designated 220. Then the space in the reservoir 114 that is open at the level of the partitioning and support plate 180 and its associated arms 190, 192 and 194 is indicated by the spaced lines that extend horizontally with a moderate upward slant to the right.

It immediately becomes evident that the solvents being discharged from the horizontal surfaces as shown by the vertical lines in FIG. 6 are easily able to fall into the open area indicated by the slanted lines and into the reservoir 114. Also, the fumes resulting from the more turbulent flow which is emitted from the turbine 132 and the centrifugal filter are contained by the housing 134 and also by the partitioning and support plate 180 that is immediately below it. Also, the circumferential lip 137 extends over the circumferential space 135 at the upper edge of the centrifugal receptacle sidewall 128 to substantially close off the upper part of the space 135. The net effect of this is that the fumes that result from the turbulent flow from the turbine 132 and the centrifugal filter are confined in the space 135 and the space between the turbine 132 and the plate 180.

Let us now discuss the matter in which the operating components of the system could be moved into and out of the reservoir 114. First, it should be noted that all of the operating components of the apparatus 110 are either directly or indirectly mounted to the partitioning and support plate 180, along with its three arms 190, 192, and 194. Also, in observing FIGS. 3 and 5, it becomes evident that the turn buckle 202 is readily accessible so that the arms 194 and 190 can easily be moved between the connecting position in FIG. 3 and the disconnect position of FIG. 5. Further, the single partitioning and support plate 180 is readily accessible so that it could be either lifted or moved in a controlled manner downwardly into the drum 114 (i.e., the reservoir 114) or pulled out of the reservoir 114, along with all of the components in the apparatus 110.

It is obvious that various modifications could be made to the apparatus and also to the precise methods used herein without departing from the basic teaching of the present invention. For example, the partitioning and support plate 180 is simply designated as a "plate". It is evident within the present invention, that there could be alternative configurations to those shown in these drawings, which would be the functional equivalent of a plate providing the same functions, but not be within a strict dictionary definition of a "plate". Also, when the singular is used (i.e., plate instead of "plates"), it is evident that this plate could in some situations be made by separate components which are joined. The scope of the invention is to be interpreted in accordance with the scope of the claims which are presented, and not reading into the scope of the invention items or features which are not recited in the claims.

While the present invention is illustrated by description of the embodiment and while the illustrative embodiment is described in detail, it is not the intention of the applicants to restrict or in any way limit the scope of the appended claims to such detail. Additional advantages and modifications within the scope of the appended claims will readily appear to those knowledgeable in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A method of washing parts with a solvent and removing foreign matter from the solvent, said method comprising:

a) providing a reservoir with a quantity of a solvent therein;

b) positioning a wash basin above the reservoir and pumping solvent from the reservoir upwardly into the basin with solvent in the basin flowing through a drain downwardly from the basin;

c) positioning a centrifugal filter to receive the solvent from the drain, with said centrifugal filter comprising a receptacle and a replaceable filter in the centrifugal filter;

d) rotating the centrifugal filter by pumping solvent from the reservoir to drive a turbine that has a drive connection to the centrifugal filter with the rotation of the centrifugal filter filtering out foreign matter which collects in the filter element and the solvent being discharged from the centrifugal filter;

e) enclosing the centrifugal filter and the turbine in an enclosing structure, and arranging the enclosing structure to cause the solvent from the centrifugal filter and the turbine to flow into a solvent collecting region where the solvent received from the centrifugal filter and the turbine is in a less turbulent state;

f) discharging the solvent from the collecting region through a discharge opening portion of the enclosing structure that is arranged to substantially enclose fumes that are generated in a less turbulent state in the collecting region;

g) said method further comprising positioning said centrifugal filter and said turbine adjacent to one another so that said centrifugal filter and said turbine have center axes of rotation which are aligned with one another;

h) said method further comprising supporting the centrifugal filter, the turbine and the enclosing structure in the reservoir by providing a main support plate section and connecting at least three arms by inner end portions thereof to the support plate section and providing outer end portions thereof to engage said reservoir, with at least two of said arms having their inner end portions connected rotatably to the main support plate section so as to be able to rotate about a vertically aligned axis between an outer reservoir engaging position and to a retracted position.

2. The method as recited in claim 1, comprising connecting a third arm of said three arms at a fixed operating position where it is non-rotatably connected to the main support plate, and with the first two arms in their retracted position, either moving the support section out of support contact with the reservoir, to be able to remove the main support plate section or moving the first and second arms to their spread position so that the three outer engaging portions are in engagement with the reservoir.

3. The method as recited in claim 1, further comprising providing said reservoir as a cylindrical drum having an inner positioned circumferential internal groove, then positioning the outer end portions of said arms into the circumferential groove to obtain support from said drum.

* * * * *